US007585397B2

(12) United States Patent
Bollinger

(10) Patent No.: US 7,585,397 B2
(45) Date of Patent: Sep. 8, 2009

(54) AUTOMATIC POTENTIAL CONTROL CATHODIC PROTECTION SYSTEM FOR STORAGE TANKS

(75) Inventor: John C. Bollinger, Huntington Beach, CA (US)

(73) Assignee: Farwest Corrosion Control Company, Gardena, CA (US)

( * ) Notice: Subject to any disclaimer, the term of this patent is extended or adjusted under 35 U.S.C. 154(b) by 320 days.

(21) Appl. No.: 11/556,163

(22) Filed: Nov. 2, 2006

(65) Prior Publication Data

US 2007/0251834 A1 Nov. 1, 2007

Related U.S. Application Data

(60) Provisional application No. 60/746,043, filed on Apr. 30, 2006.

(51) Int. Cl.
*C23F 13/04* (2006.01)
*C23F 13/22* (2006.01)

(52) U.S. Cl. ..... 204/196.02; 204/196.06; 204/196.11; 204/196.26; 204/196.22; 204/196.23; 204/196.24; 204/196.25; 204/196.36; 204/196.37; 205/725; 205/726; 205/727; 205/730; 205/732; 205/733; 205/740

(58) Field of Classification Search ..... 204/196.02, 204/196.06, 196.11, 196.26, 196.22–196.25, 204/196.36, 196.37; 205/725–727, 730, 205/732, 733, 740

See application file for complete search history.

(56) References Cited

U.S. PATENT DOCUMENTS

| | | | | |
|---|---|---|---|---|
| 3,714,004 | A * | 1/1973 | Riggs et al. | 205/727 |
| 4,080,272 | A * | 3/1978 | Ferry et al. | 205/726 |
| 5,627,414 | A * | 5/1997 | Brown et al. | 205/726 |
| 6,617,855 | B2 * | 9/2003 | Flatt et al. | 324/326 |

* cited by examiner

*Primary Examiner*—Bruce F Bell
(74) *Attorney, Agent, or Firm*—Loza & Loza, LLP; Julio M. Loza

(57) ABSTRACT

A novel cathodic protection system is provided that automatically controls and adjusts the voltage potential between an anode and a structure to protect the structure from corrosion. The cathodic protection system is self-powered, requiring no external power source or batteries. A cathodic protection circuit is configured to provide a cathodic protection current from the anode to the structure through an electrolyte. A power generation circuit is configured to generate power from a galvanic cell formed from the anode and an isolated electrode when cathodic protection is interrupted. A voltage potential control circuit is powered by the power generation circuit and is configured to (a) determine a structure-to-electrolyte reference voltage for the electrolyte and structure, and (b) adjust the cathodic protection current from the anode to the structure to maintain the reference voltage substantially the same as a set voltage.

19 Claims, 4 Drawing Sheets

AUTOMATIC POTENTIAL CONTROL CATHODIC PROTECTION SYSTEM FOR STORAGE TANKS

CLAIM OF PRIORITY UNDER 35 U.S.C. §119

The present Application for Patent claims priority to Provisional Application No. 60/746,043 entitled "Automatic Potential Control Cathodic Protection System for Storage Tanks" filed Apr. 30, 2006 and assigned to the assignee hereof and hereby expressly incorporated by reference.

FIELD

The invention relates to the field of corrosion control of metal surfaces. In particular, one embodiment of the invention relates to an automatic and self-powered cathodic protection system that controls corrosion of metal tanks and pipes.

BACKGROUND

Cathodic protection is a technique to control the corrosion of a metal surface by making that surface the cathode of an electrochemical cell. This method is often used to protect metal structures from corrosion. Cathodic protection systems are commonly used to protect steel, water, fuel pipelines, tanks, steel pier piles, ships, and offshore oil platforms. An undesirable side effect of improperly performed cathodic protection is the generation of molecular hydrogen, leading to its absorption in the protected metal and subsequent hydrogen embrittlement of said metal.

Historically water storage tanks have had cathodic protection systems designed to operate over a large range of loads. In years past, a typical 3 million gallon storage tank with a new coal tar coating would require a small amount of cathodic protection current. However the old technology coal tar coatings would degrade in time. As the coating degrades the cathodic protection current requirement increases. As a result of the expected coating degradation, most cathodic protection systems installed were Impressed Current Cathodic Protection (ICCP) systems which use anodes connected to a DC power source (a cathodic protection rectifier) to provide the necessary current levels. The operating output of the rectifier is adjusted to an optimum level by an operator after conducting various voltage measurements of the tank to water potentials.

In recent years, newly developed high tech epoxy coatings have proven to have long term durability and stable dielectric efficiency. As a result a typical 3 million gallon reservoir with a new epoxy coating requires relatively little current (e.g., less than 100 milliamperes of current), and can easily be protected by a galvanic cathodic protection system utilizing sacrificial anodes. Galvanic anodes for cathodic protection are typically made from various alloys of magnesium zinc and/or aluminum. The electrochemical potential, current capacity, and consumption rate of these alloys are well suited for cathodic protection. Galvanic anodes are designed and selected to have a more "active" voltage (technically a more negative electrochemical potential) than the metal of the structure being protected (e.g., tank, etc.). For effective cathodic protection, the potential of the structure is polarized more negative until the corrosion reaction is halted. The galvanic anode continues to corrode, slowly consuming the anode material. The difference in electrochemical potential between the anode and the cathode causes current to flow from the anode to the structure (cathode).

The American Water Works Association (AWWA) standards and National Association of Corrosion Engineers (NACE) recommended practices suggest that tank-to-water potentials be maintained between −0.850 and −1.100 volts with respect to a stable copper-copper sulfate reference electrode. Exceeding the −1.200 volt potential limit has demonstrated in some instances to be detrimental to the coating by "over protection" which may produce hydrogen and cause the protective coating in the tank to degrade, lift, separate from the tank wall. Therefore, when using a magnesium anode there is a need to provide some method to prevent over potentials. A resistor system may be installed in series with the magnesium anodes to limit the current output. However, this type of control system requires frequent adjustments since the voltage potential in a tank may change as the amount of liquid held in the tank changes. Another option is to install an automatic-constant potential ICCP system.

It is common practice for cathodic protection designers to specify that the tank to water potential be an "IR Free" measurement. That is, the measurements are performed while the no current flows between the anode and tank (e.g., at an instant when cathodic protection is turned off). This is not a problem with the modern IR free impressed current rectifier systems. However, because most magnesium anode systems are "On" continuously, it is very difficult/impractical to capture a true IR free potential measurement.

With the improved epoxy coating systems, it is not unusual to provide full protection for a 3 million gallon reservoir with less than 100 milliamperes of current. This has created a double-edged sword for cathodic protection designers. With the low current requirement, a newly coated tank is a perfect candidate for a magnesium system. However, even the lowest rated current output cathodic protection rectifiers have difficulty operating in the milliampere range. They tend to be unstable and difficult to adjust at the low end of this operating power range. The current fix for this problem is to install a "dummy" load or balancing resistor across the output to "fool" the rectifier into believing that it is operating at a higher current.

A corrosion protection system using a magnesium anode would require series balancing resistor to keep the anode-to-tank current low enough to avoid over protection. However, using such balancing resistor requires frequent adjustment to maintain the desired potential range while the problem of capturing IR free potentials still persists. The need for adjustment may occur for various reasons such as, for example, a change in the water level of the tank. Thus, there is a need for an IR free automatic potential controlled impressed current system.

Additionally, providing power to operate the circuitry of an automatic potential control cathodic protection system is very difficult in many cases. For example, water storage tanks are often located in remote areas where an independent power source to operate the potential control circuits is unavailable. Thus, a way or method to provide power to such automatic control system is needed.

SUMMARY

One embodiment provides a cathodic protection apparatus for protecting a structure from corrosion. A cathodic protection circuit is configured to provide a cathodic protection current from an anode to the structure through an electrolyte. A power generation circuit is configured to generate power from a galvanic cell formed from the anode and an isolated electrode. A voltage potential control circuit is powered by the power generation circuit and configured to (a) determine a structure-to-electrolyte reference voltage for the electrolyte and structure, and (b) adjust the cathodic protection current from the anode to the structure to maintain the reference voltage substantially the same as a set voltage. The set voltage may be preconfigured by an operator to an appropriate level that provides corrosion protection for the structure. In some implementations, the structure may be a water tank, pipeline, or ship. The cathodic protection current is interrupted while the power generation circuit generates power.

Consequently, the power generation circuit is halted when cathodic protection current flows to the structure. The cathodic protection apparatus may also include a power storage device for storing power when the power generation circuit generates power. Additionally, a clock may be configured to start the power generation circuit at particular intervals. One option provides a power storage device for storing power from the power generation circuit. Another option provides an amplifier for amplifying the voltage between the anode and the isolated electrode to power the voltage potential control circuit.

Another embodiment of the invention provides an apparatus for cathodic corrosion protection of a storage tank. A voltage potential controller is configured to maintain a reference voltage potential between the storage tank and a stable reference electrode inside the storage tank approximately equal to an internally generated set voltage. An adjustable current controller (e.g., adjustable impedance or pulse width modulation (PWM)) is coupled to the voltage potential controller. The adjustable current controller is adjustable by the voltage potential controller to maintain a desired tank-to-electrolyte voltage potential between the storage tank and an electrolyte held by the storage tank. A power generation circuit is configured to obtain power from a galvanic cell formed in the storage tank between an anode and an isolated electrode and provide power to the voltage potential controller. The isolated electrode may be made of a material that is electro positive relative to the anode. A clock is configured to cycle current flow between the anode and storage tank On and Off while concurrently switching the power generation circuit Off and On, respectively, according to a configurable duty cycle. For example, the duty cycle may be preset by a user and/or may be varied to suit site specific requirements. The voltage potential controller may include a voltage comparator that compares the reference voltage potential to the internally generated set voltage to determine a voltage differential. The voltage potential controller adjusts the adjustable current controller to regulate current flow between the anode and storage tank and maintain a zero differential between the reference voltage and internally generated set voltage. The voltage potential controller may also obtain the reference voltage potential between the storage tank and the stable reference electrode while the current flow between the anode and storage tank is turned Off. In one implementation, the anode is a magnesium anode. An energy storage device is coupled to the power generation circuit to store the power obtained by the power generation circuit.

Another implementation provides a method for adjusting cathodic protection of a structure. Cathodic protection of the structure is suspended and power is generated from the structure from a voltage differential between the structure and an isolated electrode. A structure-to-electrolyte reference voltage is determined and a cathodic protection current is adjusted to maintain the reference voltage substantially the same as a set voltage. The power generation is then halted or suspended and cathodic protection of the structure resumes. Some of the generated power is stored in a power storage device which can then power a clock. The clock may start the power generation circuit at particular time intervals.

DETAILED DESCRIPTION OF THE INVENTION

In the following detailed description of the invention, numerous specific details are set forth in order to provide a thorough understanding of the invention. However, the invention may be practiced without these specific details. In other instances well known methods, procedures, and/or components have not been described in detail so as not to unnecessarily obscure aspects of the invention.

One aspect of the invention provides a novel cathodic protection controller that bridges the gap between simple magnesium anode cathodic protection systems and, in many instances, replaces the more complex and expensive automatic potential controlled impressed current rectifier systems. This cathodic protection control circuit provides automatic-constant potential (IR Free) control for magnesium anode systems for internal cathodic protection of liquid (e.g., water) storage tanks.

Another unique and novel feature provides automatic potential control system to be self-powered, requiring no external power source or batteries. This novel control system utilizes a small portion of the energy produced by the magnesium anodes to power the electronic circuit. In one embodiment, using low-powered circuitry, the control system requires less than ten milliamperes to operate all the functions of the automatic potential control system.

Figure 1:
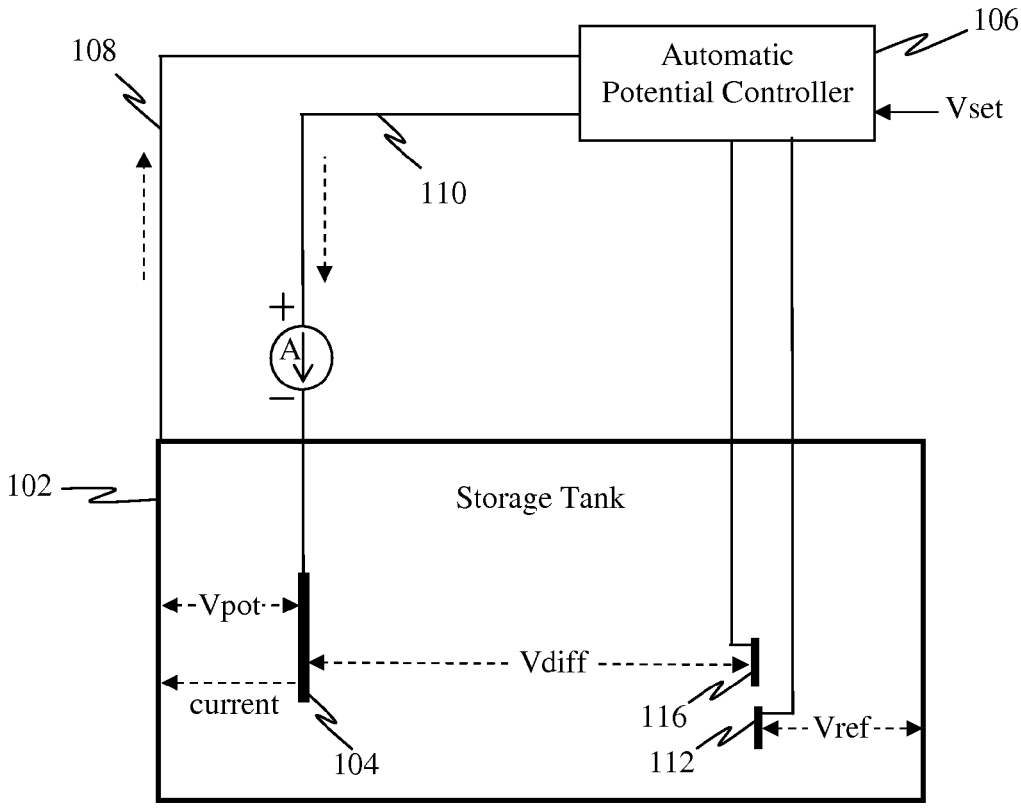
FIG. 1 is a block diagram illustrating the components and operation of the automatic potential control for cathodic protection systems according to one embodiment of the invention.

FIG. 1 is a block diagram illustrating the components and operation of an automatic (voltage) potential controller 106 for cathodic protection systems according to one embodiment of the invention. A metal storage tank 102 includes an anode 104 coupled to an automatic potential controller 106 that maintains a reference voltage Vref between a reference electrode 112 and the tank 102 at a fixed level or within a range. The tank 102 and anode 104 form a galvanic cell, where current flows from the anode 104 through an electrolyte (e.g., water in the tank 102) to the cathode (tank 102). With current flowing from the anode 104 to the tank 102 (cathode), the anode 104 corrodes (very slowly) thereby protecting the tank 102 from corrosion. For purposes of this example, the liquid/electrolyte held in the tank 102 is water but other liquids that function as an electrolyte may be stored in different implementations of the invention. Similarly, for this example, the anode 104 is a magnesium anode but other types of anodes, including zinc and aluminum, may be used in other implementations.

The automatic potential controller 106 is electrically coupled to the tank 102 and the anode 104 via conductors 108 and 110 to complete a circuit through which current flows from the anode 104 to the tank 102. The automatic potential controller 106 includes a current control controller (variable impedance or PWM) that is automatically adjusted to maintain the reference voltage Vref between the reference electrode 112 and the tank 102 at a fixed level or within a range. By adjusting this current controller, the current flow (and thus voltage potential Vpot) between the anode 104 and the tank 102 is adjusted, consequently adjusting the reference voltage Vref.

The automatic potential controller 106 is also configured to compare a tank-to-water reference voltage Vref to an internally generated set voltage Vset and modulate the anode current output to maintain a zero differential between Vref and Vset. The reference voltage Vref is the voltage between an isolated reference electrode 112 within the electrolyte (i.e., water in the tank) and the tank 102. The set voltage Vset is the desired tank to electrolyte potential that the operator wishes to maintain within the tank 102.

During startup of the automatic (voltage) potential controller 106, it may take from a few minutes to many hours to polarize the tank 102. During this period, there may be a differential between the reference voltage Vref to the set voltage Vset. To expedite polarization, the automatic potential controller 106 may maximize current flow between the anode 104 and tank 102 until the differential between the reference voltage Vref to the set voltage Vset approaches zero. After the initial polarization, the automatic potential controller 106 adjusts the current flow between the anode 104 and tank 102 to maintain the zero differential between the reference voltage Vref to the set voltage Vset.

This automatic potential controller 106 also incorporates an automatic "IR Free" potential control circuit. IR free means that the system compensates for a voltage drop Vref in the electrolyte (e.g., water in tank 102) between the reference electrode 112 and the protected tank 102 structure. According to one aspect of the invention, this is accomplished by momentarily interrupting the current to the anode 104 and immediately (e.g., within five milliseconds) measuring the tank-to-water potential Vref. In one implementation, the duty cycle (in which the anode current is turned On and Off) may be approximately 90% On/10% Off, at between 10 to 40 Hz. During the 10% Off cycle three events occur. First, the automatic potential controller 106 compares the reference voltage potential Vref with the internally generated set potential voltage Vset. Second, the automatic potential controller then modulates the output anode current to maintain a zero differential between Vref and Vset. Third, power is generated from a magnesium anode (104) and the isolated copper electrode (116) to power the automatic controller circuit 106 or recharge a power source device (e.g., capacitor or battery).

Another aspect of the invention provides for the automatic potential controller 106 to be powered via a galvanic cell formed between the magnesium anode 104 and an isolated electrode 116. Isolated electrode 116 may include a material, such as copper for example, that is electro positive with respect to the magnesium anode 104 or the material from which anode 104 is made. During the 10% Off cycle (in which no current flows between the anode 104 and tank 102), the automatic potential controller may utilize the open-circuit magnesium anode 104 and the isolated electrode 116 as a power source to boot up and/or power its electronic circuits or recharge a power storage device. For example, the automatic potential controller may be powered from a power storage device (e.g., battery or capacitor) that is recharged by the galvanic cell, formed by anode 104 and isolated electrode 116, before and/or after measuring the tank-to-water potential Vref. That is, in one example, the recharging mechanism formed by a galvanic cell (formed between the magnesium anode 104 and an isolated electrode 116) may be suspended (does not operate) while the tank-to-water potential Vref is being obtained. In this recharging mechanism, the voltage Vdiff between the anode 104 and isolated electrode 116 may be, for example, 0.8 to 1.0 volts after polarization of the magnesium anode 104 and isolated electrode 116. The automatic potential controller 106 may include a low power consumption circuit that can amplify the input Vdiff to +3 volts and store some power (e.g., in capacitors) to keep the circuit operational when current flows from the anode 104. The low power consumption circuit of the automatic potential controller 106 also operates to: (1) compare the reference voltage Vref to the internally generated set voltage Vset, and (2) adjust the current flow to the anode 104 to maintain a zero differential between Vref and Vset. By this novel self-powered circuit, the automatic potential controller 106 does not require an external power source or batteries to operate. This allows installation of the automatic potential controller 106 in locations where an external power source is unavailable without the maintenance and upkeep of changing batteries.

In various implementations, the duty cycle in which the current to the anode 104 is turned On and Off may be varied depending on such factors as (1) the degradation of the anode 104, (2) the polarization of the isolated electrode 116 electrode, and (3) the amount of current that is needed to run the automatic potential controller 106 circuit and/or recharge the power storage device.

In some implementations, a plurality of anodes 104 and/or isolated electrodes 116 may be used. Similarly, a plurality of reference electrodes 112 may be employed.

In yet other implementations, a separate anode (other than anode 104) may be employed. Additionally, when generating power to charge the power storage device and/or operate the automatic potential controller 106, some implementations may use the isolated electrode 116 as the "cathode" while using the electrode 104 as the "anode". Alternatively, when generating power, the isolated electrode 116 may be used as the "anode" while electrode 104 is used as the "cathode". That is, the function of electrode 104 may change depending on whether it is providing cathodic protection to the tank (where it may act as the anode) or whether it is used to generate power.

Figure 2:
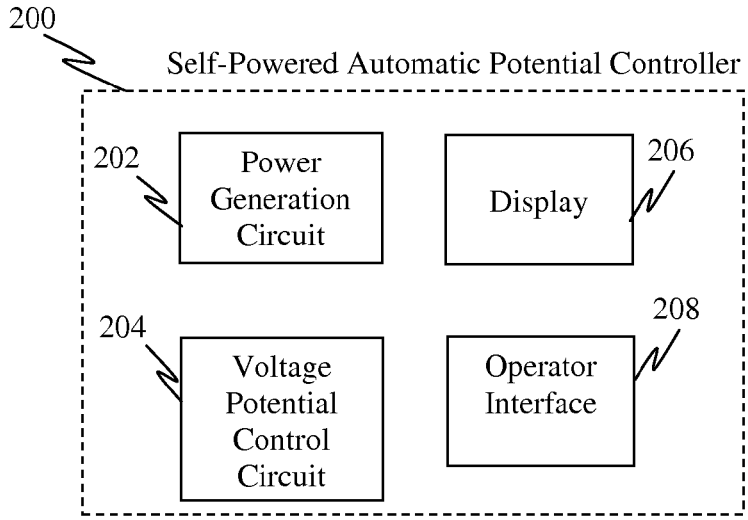
FIG. 2 is a block diagram illustrating general components of an automatic potential controller.

FIG. 2 is a block diagram illustrating general components of an automatic (voltage) potential controller 200. One function of the automatic potential controller 200 is to maintain a voltage potential at a fixed level or within a range between a metal storage tank and an anode in an electrolyte held by the tank. The tank and anode form a galvanic cell, where current flows from the anode through the electrolyte (e.g., water in the tank) to the cathode (tank), thereby protecting the tank from corrosion.

The automatic potential controller 200 includes a power generation circuit 202 configured to generate power from a voltage differential (through the electrolyte in the tank) between the anode and an isolated electrode. The current between the anode and tank (cathode) is momentarily interrupted for the power generation circuit 202 to operate. In some implementations, the power generation circuit 202 may store power (e.g., in a capacitor or battery) to power the automatic potential controller. Because this power generation circuit obtains power from the tank itself, the automatic potential controller 200 is said to be self-powered.

The power generation circuit 202 (e.g., rechargeable batteries or capacitors therein) is configured to power a potential control circuit 204. The potential control circuit 204 is a low-power consumption circuit configured to determine the difference between a reference voltage in the tank and a desired set voltage (provided by the operator). Depending on the difference between the reference voltage and set voltage, the potential control circuit 204 may adjust the current flow between the anode and the tank. The power generation circuit 202 may be halted or suspended (i.e., by interrupting current flow between the anode 104 and isolated electrode 116) while the voltage potential control circuit 204 obtains the tank-to-water potential Vref.

Once the voltage potential control circuit 204 has operated to obtain the reference voltage in the tank and/or adjust the cathodic protection current and the power generation circuit 202 has recharged an internal power source device, their operations are halted and the anode-to-tank current flow may resumes (thereby providing cathodic protection to the tank).

A display 206 may serve to provide an operator of the automatic potential controller 200 a way to set the desired reference voltage via an operator interface 208 (e.g., keyboard, turn knobs, or increase/decrease buttons or toggle switch). The display 206 may also allow the operator to read the reference voltage in the tank and the current between the anode and the tank. In one implementation, the display may have be automatically turned-off after a few seconds to conserve power.

Figure 3:
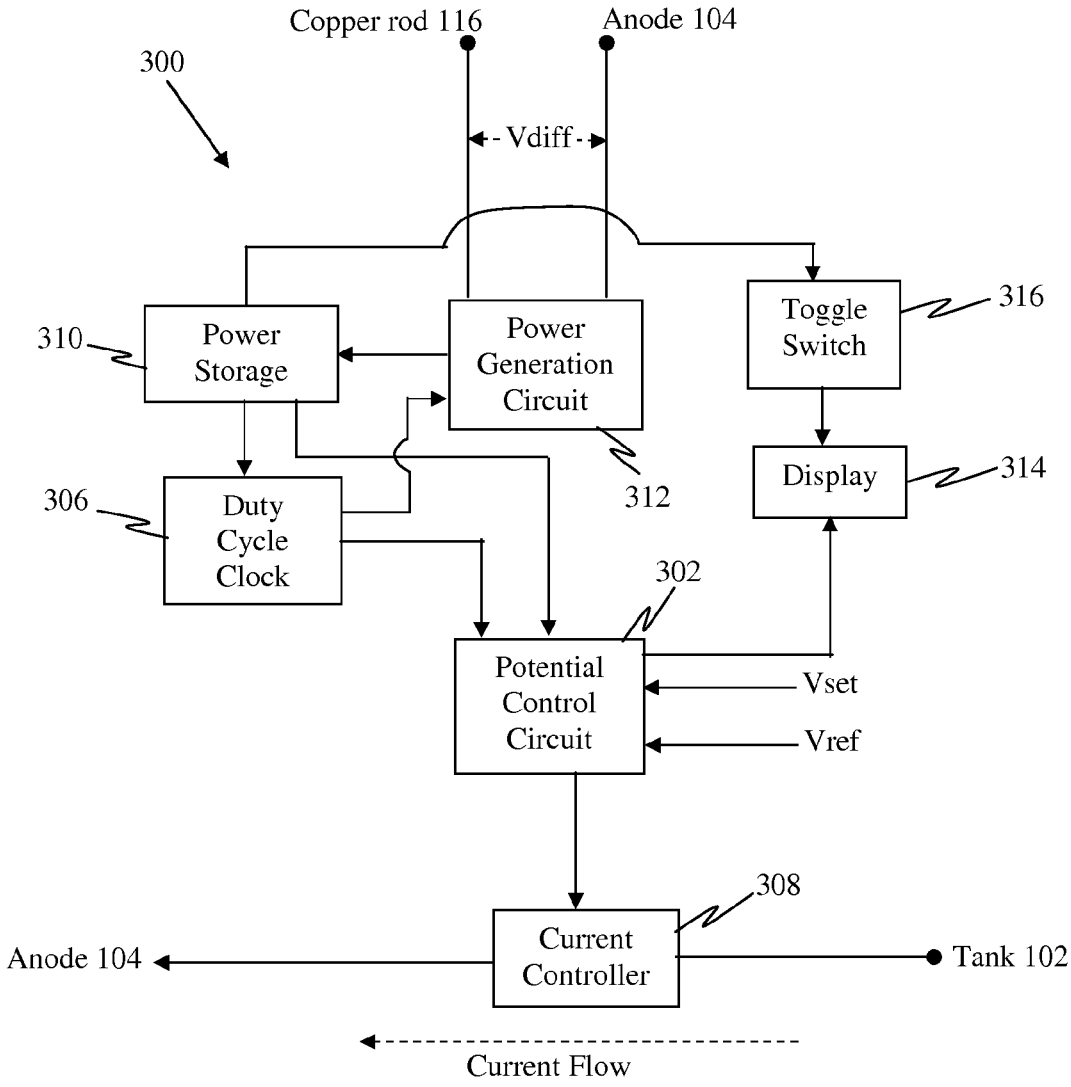
FIG. 3 is a block diagram illustrating one embodiment of an automatic potential controller.

FIG. 3 is a block diagram illustrating one embodiment of an automatic (voltage) potential controller 300. The automatic potential controller 300 (e.g., 106 in FIG. 1 or 200 in FIG. 2) includes a potential control circuit 302 that is configured to compare a tank-to-water reference voltage Vref to an internally generated set voltage Vset and modulate the anode current output by adjusting a variable current controller 308 to maintain a zero differential between Vref and Vset. The reference voltage Vref is the voltage between an isolated reference electrode 112 (FIG. 1) within the electrolyte (i.e., water in the tank) and the tank 102 (FIG. 1). The set voltage Vset is the desired tank to electrolyte potential that the operator wishes to maintain within the tank 102 (FIG. 1). The set voltage Vset may be initially set by an operator to a desired voltage potential.

The controller 300 may also include a duty cycle clock 306 that turns the variable current controller 308 On and Off according to a predetermined duty cycle (e.g., 90% On/10% Off). When the variable current controller 308 is turned On, current flows between the anode 104 and the tank 102. When the variable current controller 308 is turned Off, the current flow from anode 104 (FIG. 1) to the tank 102 is also switched Off or interrupted. The potential control circuit 302 is powered by the power storage device 310 and performs its operations during the time the variable current controller 308 is switched Off. Within the first N milliseconds (e.g., N=5 milliseconds) of the cycle when the variable current controller 308 is turned Off, the potential control circuit 302 measures the reference voltage potential Vref (i.e., the tank-to-electrolyte potential) between reference electrode 112 and the tank 102. This reference voltage Vref is considered a true IR free potential. The reference voltage Vref is then compared to a set voltage Vset by the potential control circuit 302. Upon completion of this measurement of the reference voltage Vref and for the remainder of the Off cycle, the power generation circuit 312 draws energy from a galvanic cell established between the anode 104 and the isolated electrode 116 (voltage difference Vdiff) and stores it in the power storage device 310.

In some implementations, a display 314 (e.g., LCD) coupled to the potential control circuit and configured to provide current and voltage readings to an operator. For example, the display 314 may show the actual IR free potential Vref, the set voltage potential Vset and/or the real time system current and other system functions or information. To limit the power consumption of the display 314, a toggle switch 316 may be employed to turn power On/Off to the display. The toggle switch 316 may be configured to operate for a fixed amount of time (e.g., 5 seconds, 30 seconds, etc.) before it automatically turns power to the display 314 Off to minimize power consumption. An operator can reset the toggle switch 316 to turn the power to the display 314 On again.

The block diagram in FIG. 3 is intended to illustrate the features of the automatic potential controller 300 and not necessarily the circuit components or layout. An actual implementation of the automatic potential controller 300 may include more or less components and different configurations and/or sequences of operation without departing from the present invention.

Figure 4:
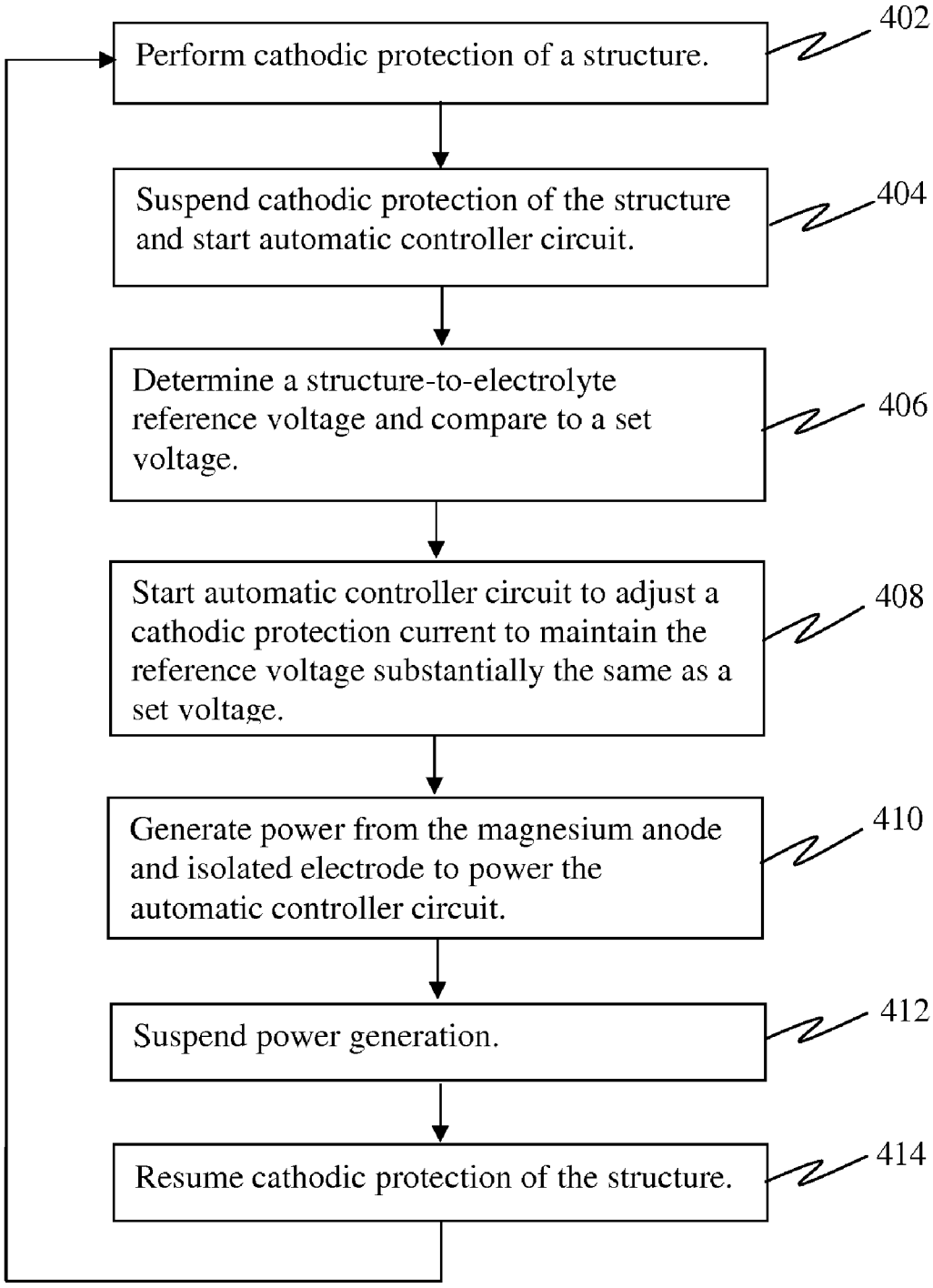
FIG. 4 illustrates a method for providing automatic cathodic protection to a structure according to one implementation.

FIG. 4 illustrates a method for providing automatic cathodic protection to a structure according to one implementation. Cathodic protection of a structure is performed 402, for example, by creating a galvanic cell between the structure and an anode. Current flows from the anode through an electrolyte (e.g., water) to the structure thereby protecting the structure from corrosion. The structure may be a storage tank, pipeline, ship, etc., that is protected from corrosion. Cathodic protection of the structure is suspended 404 (momentarily) and three events occur. First, a structure-to-electrolyte reference voltage is measured and compared to a set voltage 406. Second, an automatic controller circuit is started to adjust a cathodic protection current to maintain the reference voltage substantially the same as a set voltage 408. Third, power may be generated from a magnesium anode (104) and the isolated copper electrode (116) to power the automatic controller circuit 410. The current drawn from the galvanic cell formed by the anode and isolated electrode serves to power the automatic controller circuit. The set voltage may be configured by an operator to an appropriate level that provides corrosion protection for the structure. Power generation is suspended 412 and cathodic protection of the structure then resumes 414 with current flowing from the anode to the structure.

Figure 5:
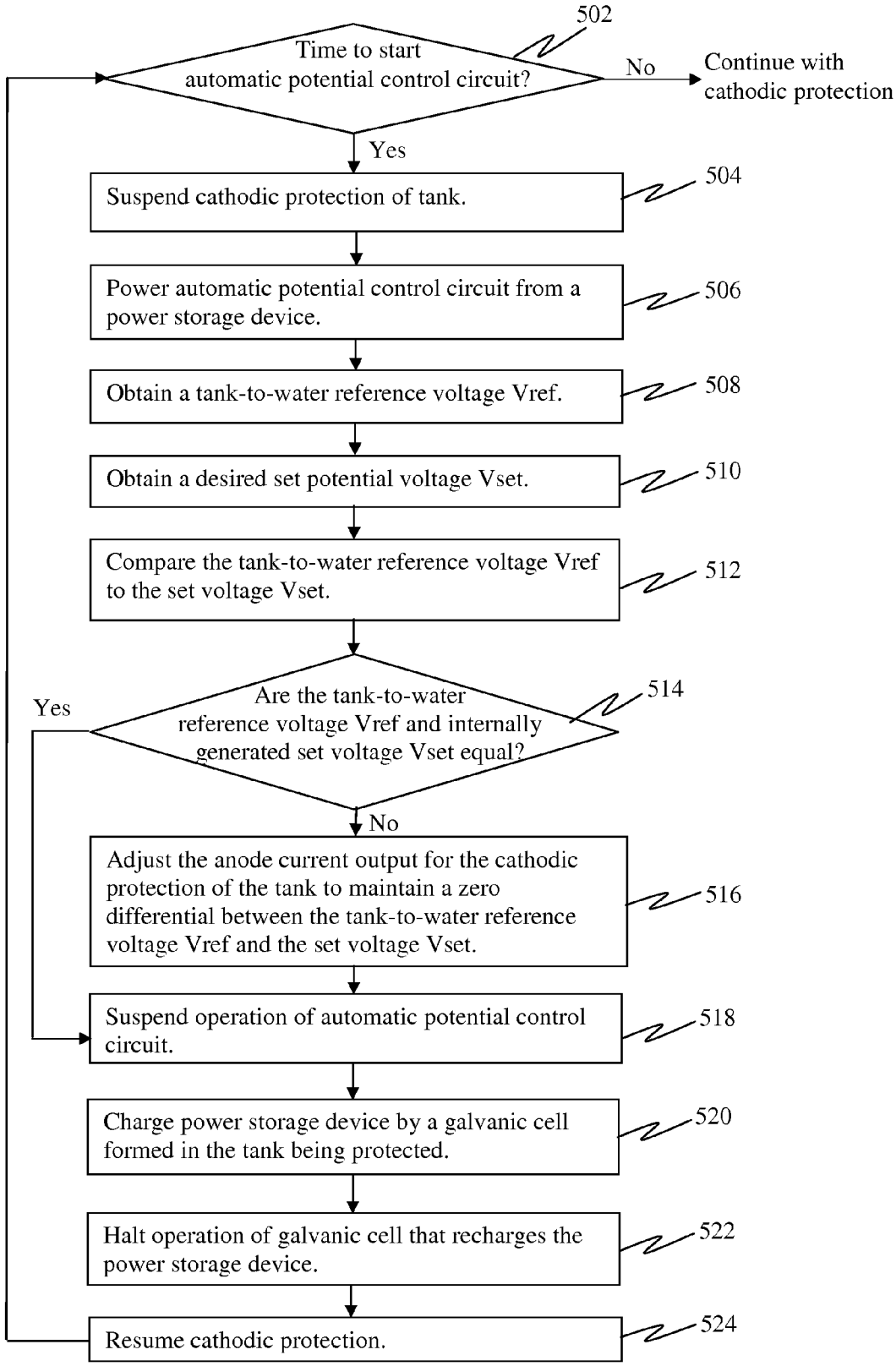
FIG. 5 illustrates a method for operating a self-powered automatic potential controller for cathodic protection of a structure, such as a water tank, according to one implementation.

FIG. 5 illustrates a method for operating a self-powered automatic potential controller for cathodic protection of a structure, such as a water tank, according to one implementation. The automatic controller is configured to determine when the automatic potential control circuit should be started 502. For example, a clock (e.g., duty cycle clock) may start the automatic potential control circuit every N milliseconds, seconds, minutes, hours, or days, etc., where N is a positive integer. Such clock may run on a small amount of power stored in a rechargeable power storage device (e.g., capacitor, etc.). If it is time to start the automatic potential control circuit, cathodic protection of the tank is suspended 504. The automatic potential control circuit is then powered from a power storage device 506, such as a battery or capacitor for example. A tank-to-water reference voltage Vref is then obtained 508. In one example, this may be accomplished by measuring the voltage between the tank and a reference electrode in the electrolyte held by the tank. A desired set potential voltage Vset is then obtained 510. This set potential voltage Vset may be preconfigured by an operator and/or stored by the automatic potential control circuit. The tank-to-water reference voltage Vref is compared to the set voltage Vset 512 to determine whether the tank-to-water reference voltage Vref is equal to the set voltage Vset 514. If Vref is not equal to Vset, the anode current output for the cathodic protection of the tank is adjusted to maintain a zero differential between the tank-to-water reference voltage Vref and the set voltage Vset 516. The operation of the automatic potential control circuit is then suspended 518 or halted.

The power storage device is then recharged from a galvanic cell formed in the tank or structure being protected 520. For example, an isolated electrode and an anode in an electrolyte (e.g., water) held by the tank may be used to form the galvanic cell. The galvanic cell operates for a period of time to recharge the power storage device. The recharging process of the galvanic cell is then halted or disabled 522 and cathodic protection of the tank can then resume 524. Note that in various alternative embodiments, the recharging of the power storage device by galvanic cell formed in the tank being protected may be performed before and/or after the automatic potential control circuit operates.

In various implementations, the automatic potential control circuit may be a processor configured to automatically adjust a current to provide cathodic protection to a structure and obtains its power from a galvanic cell formed in the structure being protected. In other implementations, the automatic potential control circuit may include logic, analog, and/or digital components to perform these functions.

One or more of the components, steps, and/or functions illustrated in FIGS. 1-5 may be rearranged and/or combined into a single component, step, or function or embodied in several components, steps, or functions without departing from the invention. Additional elements, components, steps, and/or functions may also be added without departing from the invention. The apparatus, devices, and/or components illustrated in FIGS. 1, 2, and/or 3 may be configured to perform one or more of the methods, features, or steps described in FIGS. 4 and/or 5.

Those of skill would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art. Additionally, it is possible to implement the invention or some of its features in hardware, programmable devices, firmware, software or a combination thereof. The invention or parts of the invention may also be embodied in a processor readable storage medium or machine-readable medium such as a magnetic, optical, or semiconductor storage medium.

It should be noted that the foregoing embodiments are merely examples and are not to be construed as limiting the invention. The description of the embodiments is intended to be illustrative, and not to limit the scope of the claims. As such, the present teachings can be readily applied to other types of apparatuses and many alternatives, modifications, and variations will be apparent to those skilled in the art.

The invention claimed is:

1. A cathodic protection apparatus for protecting a structure from corrosion, comprising:

a cathodic protection circuit configured to provide a cathodic protection current from an anode to the structure through an electrolyte;

a power generation circuit configured to generate power from a galvanic cell formed from the anode and an isolated electrode having a voltage differential through the electrolyte; and a voltage potential control circuit configured to obtain a structure-to-electrolyte reference voltage for the electrolyte and structure, and adjust the cathodic protection current from the anode to the structure to maintain the reference voltage substantially the same as a set voltage.

2. The cathodic protection apparatus of claim 1, wherein the voltage potential control is further configured to store the set voltage, the set voltage configurable to an appropriate level that provides corrosion protection for the structure.

3. The cathodic protection apparatus of claim 1, wherein the structure is a water tank.

4. The cathodic protection apparatus of claim 1, wherein the power generation circuit is adapted to interrupt the cathodic protection current while the power generation circuit generates power.

5. The cathodic protection apparatus of claim 1, wherein the cathodic protection circuit is adapted to wait until the power generation circuit is halted before providing cathodic protection current to the structure.

6. The cathodic protection apparatus of claim 1, further comprising:

a power storage device for storing power when the power generation circuit generates power, the power storage device for providing power to the voltage potential control circuit.

7. The cathodic protection apparatus of claim 1, further comprising:

a clock configured to trigger the power generation circuit and voltage potential control circuit at particular intervals.

8. The cathodic protection apparatus of claim 1, wherein the power generation circuit is adapted to operate only after the structure-to-electrolyte reference voltage is obtained.

9. The cathodic protection apparatus of claim 1, further comprising:

an amplifier for amplifying the voltage between the anode and the isolated electrode to power the voltage potential control circuit.

10. An apparatus comprising:

a voltage potential controller configured to maintain a reference voltage potential between a storage tank and a stable reference electrode inside the storage tank approximately equal to an internally generated set voltage;

an adjustable current controller coupled to the voltage potential controller, wherein the adjustable current controller is adjustable by the voltage potential controller to maintain a desired tank-to-electrolyte voltage potential between the storage tank and an electrolyte held by the storage tank;

a power generation circuit configured to obtain power from a galvanic cell formed in the storage tank between an anode and an isolated electrode having a voltage differential through the electrolyte and provide power to the voltage potential controller; and a clock configured to cycle current flow between the anode and storage tank On and Off while concurrently switching the power generation circuit Off and On, respectively, according to a configurable duty cycle.

11. The apparatus of claim 10 wherein the voltage potential controller includes a voltage comparator that compares the reference voltage potential to the internally generated set voltage to determine a voltage differential.

12. The apparatus of claim 11 wherein the voltage potential controller is adapted to adjust the adjustable current controller to regulate current flow between the anode and storage tank and maintain a zero differential between the reference voltage and internally generated set voltage.

13. The apparatus of claim 10 wherein the voltage potential controller is adapted to obtain the reference voltage potential between the storage tank and the stable reference electrode while the current flow between the anode and storage tank is turned Off.

14. The apparatus of claim 10 wherein the anode is a magnesium anode.

15. The apparatus of claim 10 further comprising:

an energy storage device coupled to the power generation circuit to store the power obtained by the power generation circuit.

16. The apparatus of claim 10 wherein the isolated electrode is made of a material that is electro positive relative to the anode.

17. A method for adjusting cathodic protection of a structure, comprising:

suspending cathodic protection of the structure;

obtaining a structure-to-electrolyte reference voltage for an electrolyte held by the structure;

adjusting a cathodic protection current to maintain the reference voltage substantially the same as a set voltage;

generating power from the structure from a voltage differential between a magnesium anode and an isolated electrode through the electrolyte;

suspending power generation prior to performing cathodic protection of the structure; and resuming cathodic protection of the structure.

18. The method of claim 17 further comprising:

comparing the structure-to-electrolyte reference voltage to the set voltage.

19. The method of claim 17 further comprising:

storing some of the generated power in a power storage device.

* * * * *